US011255110B2

(12) United States Patent
Fan

(10) Patent No.: US 11,255,110 B2
(45) Date of Patent: Feb. 22, 2022

(54) PADLOCK

(71) Applicant: ABUS August Bremicker Soehne KG, Wetter-Volmarstein (DE)

(72) Inventor: Wai Kuen Fan, Kwun Tong (HK)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 211 days.

(21) Appl. No.: 16/509,396

(22) Filed: Jul. 11, 2019

(65) Prior Publication Data

US 2020/0018099 A1 Jan. 16, 2020

(30) Foreign Application Priority Data

Jul. 13, 2018 (DE) ..... 10 2018 117 023.8

(51) Int. Cl.

| | |
|---|---|
| ***E05B 67/24*** | (2006.01) |
| ***E05B 67/00*** | (2006.01) |
| ***E05B 67/38*** | (2006.01) |
| ***E05B 63/00*** | (2006.01) |

(52) U.S. Cl.

CPC ..... *E05B 67/24* (2013.01); *E05B 67/003* (2013.01); *E05B 67/38* (2013.01)

(58) Field of Classification Search

CPC ..... E05B 67/25; E05B 67/003; E05B 67/38; E05B 63/0056; E05B 67/02; E05B 67/22

USPC ... 70/25, 30, 38 R, 38 A, 38 B, 38 C, 49–56

See application file for complete search history.

(56) References Cited

U.S. PATENT DOCUMENTS

| | | | | |
|---|---|---|---|---|
| 3,858,419 | A * | 1/1975 | Hampton | E05B 17/002 70/55 |
| 4,464,915 | A * | 8/1984 | Moshe | E05B 67/02 70/417 |
| 5,194,845 | A | 3/1993 | Sirmon et al. | |
| 6,769,277 | B1 * | 8/2004 | Chang | E05B 67/02 70/20 |
| 8,904,833 | B1 * | 12/2014 | Liu | E05B 67/24 70/38 A |

(Continued)

FOREIGN PATENT DOCUMENTS

| | | |
|---|---|---|
| CN | 201144575 Y | 5/2008 |
| CN | 101611206 A | 12/2009 |

(Continued)

OTHER PUBLICATIONS

European Search report dated Oct. 2, 2019 in related European Patent Application No. 19180028.3 (three pages).

(Continued)

*Primary Examiner* — Lloyd A Gall
(74) *Attorney, Agent, or Firm* — Kilpatrick Townsend & Stockton LLP

(57) ABSTRACT

A to a padlock comprising a lock body and a hoop that is movable between a closed position and an open position and that has a first hoop end and a second hoop end, wherein a first hoop receiver for the first hoop end and a second hoop receiver for the second hoop end are formed in the lock body, and wherein a latch mechanism is provided that is adjustable by a cylinder core that is rotatable about a cylinder axis between a locked position in which the latch mechanism fixes the hoop in the closed position and a release position in which the latch mechanism releases the hoop for a movement into the open position.

19 Claims, 3 Drawing Sheets

(56) References Cited

U.S. PATENT DOCUMENTS

Figure 1:
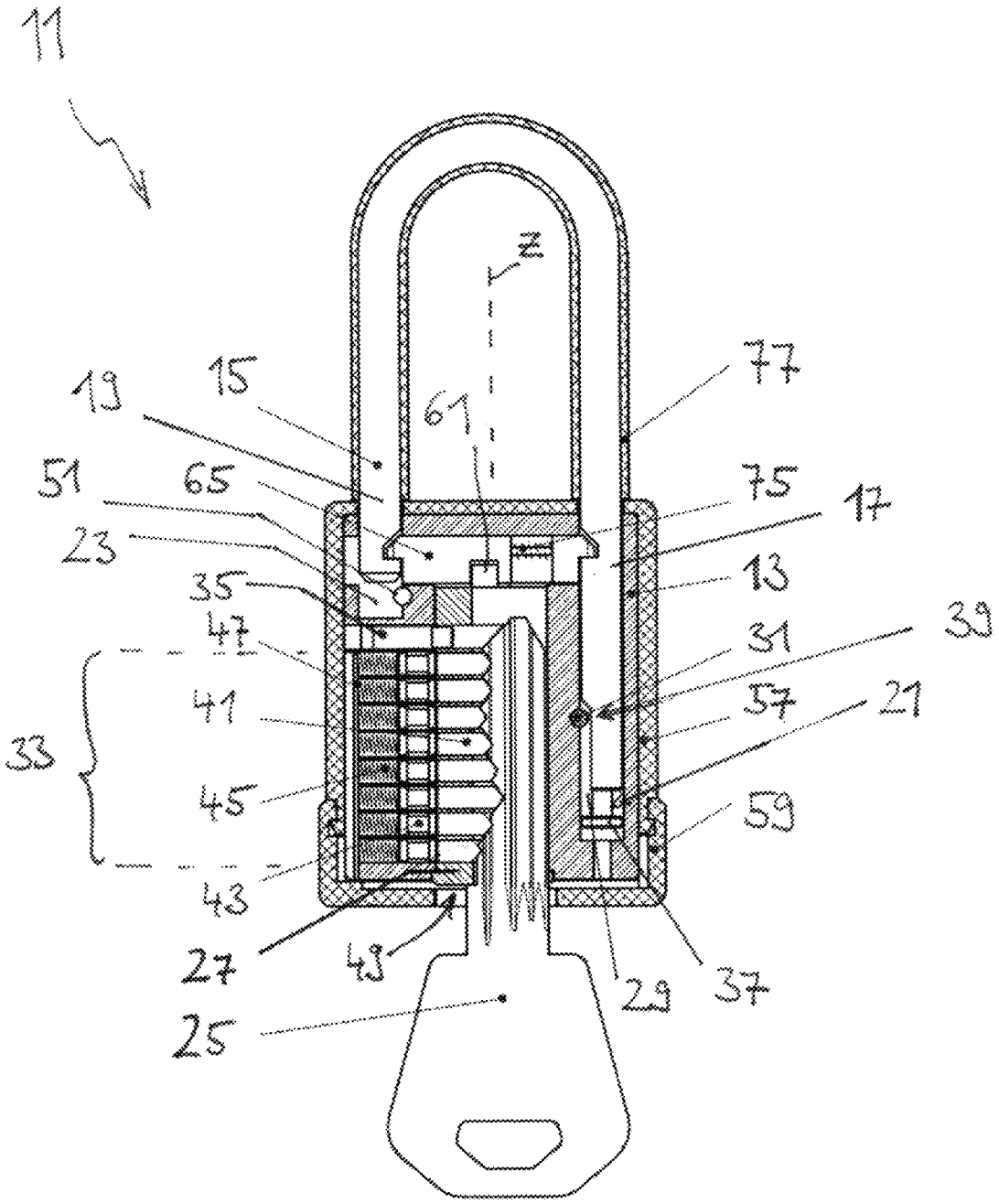

| | | | | |
|---|---|---|---|---|
| 9,428,941 | B1 | 8/2016 | Yang | |
| 2004/0055342 | A1* | 3/2004 | Chen | E05B 17/002 70/56 |
| 2004/0074265 | A1* | 4/2004 | Bruening | E05B 67/006 70/59 |
| 2004/0139772 | A1 | 7/2004 | Chang | |
| 2007/0240459 | A1 | 10/2007 | Fantl et al. | |
| 2008/0184748 | A1 | 8/2008 | Burmesch | |
| 2008/0250825 | A1* | 10/2008 | Lai | E05B 67/24 70/25 |
| 2011/0265526 | A1* | 11/2011 | Zuraski | E05B 67/003 70/18 |
| 2014/0360234 | A1 | 12/2014 | Garthe | |
| 2016/0002958 | A1* | 1/2016 | Liu | E05B 17/002 70/52 |
| 2016/0312497 | A1 | 10/2016 | McGinnis et al. | |
| 2017/0101808 | A1 | 4/2017 | Fan | |
| 2017/0122009 | A1* | 5/2017 | Ho | E05B 35/08 |
| 2018/0223566 | A1* | 8/2018 | Smith | E05B 67/003 |

FOREIGN PATENT DOCUMENTS

| | | | |
|---|---|---|---|
| CN | 202187633 | U | 4/2012 |
| CN | 204663210 | A | 9/2015 |
| DE | 10 2015 117 253 | A1 | 4/2017 |
| DE | 10 2016 125 283 | A1 | 6/2018 |

OTHER PUBLICATIONS

German Search Report dated May 23, 2019 from corresponding German Patent Application No. 10 2018 117 023.8 (two pages).

Chinese Office Action in the related Chinese Patent Application No. 201910624796.0, dated Jun. 6, 2021 (four pages).

* cited by examiner

PADLOCK

This application claims priority to German Patent Application No. 102018117023.8, filed Jul. 13, 2018, the disclosure of which is incorporated by reference herein.

The present invention relates to a padlock comprising a lock body and a hoop that is movable between a closed position and an open position and that has a first hoop end and a second hoop end, wherein a first hoop receiver for the first hoop end and a second hoop receiver for the second hoop end are formed in the lock body, and wherein a latch mechanism is provided that is adjustable by means of a cylinder core that is rotatable about a cylinder axis between a locked position in which the latch mechanism fixes the hoop in the closed position and a release position in which the latch mechanism releases the hoop for a movement into the open position.

The hoop of a padlock such as explained above is typically rigid and of U shape with two hoop limbs that form the two hoop ends and is in particular formed from steel. Such a hoop can be displaced between the closed position in which both hoop ends are introduced into the lock body and the open position in which one of the two hoop ends is still held in the lock body while the other one exits the lock body. The latch mechanism is provided to latch the hoop to the lock body in the closed position, that is to lock it against a movement, in particular a displacement, into the open position. The cylinder core that is drive effectively coupled to the latch mechanism can be actuated by means of an associated key to adjust the latch mechanism from the locked position into the release position, whereby the padlock can be opened. Such a padlock is known, for example, from the document US 2014/0360234 A1.

Initially named padlocks are, however, also known, for example from document DE 10 2015 117 253 A1, in which the hoop is designed as flexible, in particular as a cable hoop or a wire hoop. Due to their flexibility, such padlocks are in particular suitable for applications in the lockout-tagout (LOTO) area, i.e. as servicing security to fix switches and the like in a specific position. An effective protection against unauthorized access or, for example, against an unintentional switching on during an ongoing servicing procedure can hereby be ensured. In the release position of the latch mechanism, one of the two hoop ends of the flexible hoop is released for a displacement from the corresponding hoop receiver—and the hoop is thus released for a movement into the open position—with the other hoop end being secured against a removal from its hoop receiver, in particular being firmly fixed in its hoop receiver.

A padlock designed for use with a rigid hoop is, however, not usable with a flexible hoop, and vice versa. A separate development and a separate production is therefore required for each of the two padlock types with correspondingly high costs.

It is therefore in particular the underlying object of the invention to provide a padlock of the initially named kind that can be manufactured less expensively and that increases the flexibility of a manufacturer in production and in sales.

This object is satisfied by a padlock having the features in particular in that the hoop is configured as a rigid hoop or as a flexible hoop, wherein both a first retaining pin passage for a rigid hoop and a second retaining pin passage for a flexible hoop are formed in the lock body, wherein the first retaining pin passage opens into the first hoop receiver and the second pin retaining passage opens into the second hoop receiver, wherein a retaining pin is provided that is inserted into the first retaining pin passage with a rigid hoop and is inserted into the second retaining pin passage with a flexible hoop, and wherein the retaining pin, in the open position of the hoop, plunges into the first retaining pin passage and secures the first hoop end against a removal from the first hoop with a rigid hoop, and plunges into the second retaining pin passage and secures the second hoop end against a removal from the second hoop receiver with a flexible hoop.

In accordance with the invention, the same lock body and the same latch mechanism can also be used in addition to the same rotary cylinder for both padlock types. Depending on whether the padlock is to be equipped with a rigid hoop or with a flexible hoop, only a retaining pin has to be inserted either into the first retaining pin passage or into the second retaining pin passage on the assembly—in addition to the selection of the corresponding hoop. A production of the individual parts that is favorable from a unit cost aspect is possible by the use of parts of the same design. Furthermore, depending on the demand, the one or the other padlock type can be assembled or manufactured more.

It has in particular been recognized that a lock body known from document US 2014/0360234 A1 for a rigid hoop having a retaining pin passage in the region of one of the two hoop receivers can also be used for a flexible hoop by providing a further retaining pin passage in the lock body in the region of the other hoop receiver without the latch mechanism having to be changed for this purpose. It is in particular not necessary to provide a specifically configured latch mechanism such as is used in the document DE 10 2015 117 253 1 to prevent a release of the flexible hoop or of the second hoop end of the flexible hoop from the lock body in the open position of the flexible hoop.

The first and second retaining pin passages in particular extend from a front side to a rear side of the lock body. It is preferred if the first retaining pin passage opens into the first hoop receiver in a radial marginal region of the first hoop receiver and/or if the second retaining pin passage opens into the second hoop receiver in a radial marginal region of the second hoop receiver. The first and second retaining pin passages are each formed as a bore, in particular as a cylindrical bore. The two retaining pin passages can in particular respectively completely pass through the lock body. The hoop is arranged above the lock body in a position of use of the padlock. With a flexible hoop, it can in particular be a steel cable covered by a plastic.

The two retaining pin passages preferably have the same cross-section, in particular the same diameter, since then the same retaining pin can be used for both padlock types. Only one retaining pin therefore has to be produced that fits for both padlock types. It is, however, generally also possible that the cross-sections of the two retaining pin passages differ from one another so that a separate retaining pin has to be produced for each padlock type.

The second retaining pin passage is in particular arranged above the first retaining pin passage and/or beneath the latch mechanism. A typical padlock comprises a plurality of tumblers arranged above one another. The second retaining pin passage can then be arranged above the plurality of tumblers and/or the first retaining pin passage can then be arranged next to and/or beneath the uppermost of the plurality of tumblers.

It is preferred with a rigid hoop if the first hoop end has a longitudinal hoop into which the retaining pin engages to displaceably secure the first hoop end in the first hoop receiver, in particular also in the release position of the latch mechanism. In the open position of the rigid hoop, the retaining pin can then abut a blocking projection of the first hoop end bounding the longitudinal groove. It is a suitable possibility to prevent a release of the rigid hoop from the lock body in the open position of the rigid hoop.

With a rigid hoop, it is not necessary that a further retaining pin is inserted into the second retaining pin passage, in particular because as a rule no function would be associated with such a further retaining pin.

It is preferred with a flexible hoop if the second hoop end has a recess into which the retaining pin engages in order to firmly secure, i.e. to fix, the second hoop end in the second hoop receiver, in particular also in the release position of the latch mechanism. This is a suitable possibility to prevent a release of the flexible hoop or of the second hoop end of the flexible hoop from the lock body in the open position of the flexible hoop.

Provision can be made in accordance with an embodiment that a compression spring is received in the first hoop receiver that urges the first hoop end in the direction of the open position of the hoop with a flexible hoop, in particular while interposing an extension pin. An automatic, at least partial "ejection" of the rigid hoop from the closed position or of the first hoop end of the flexible hoop from the lock housing can hereby be achieved on an adjustment of the latch mechanism into the release position by actuating the cylinder core by means of the aforesaid associated key. This in particular has the advantage with a padlock having a flexible hoop that it is automatically clear which hoop end opens the flexible hoop. Otherwise the hoop end of a flexible hoop that opens the hoop would have to be marked in another manner or this would have to be discovered by trial and by pulling at the two hoop ends.

Provision can in particular be made here that an extension piece is received in the first hoop receiver with a flexible hoop. The extension piece here transmits the compressive force of the compression spring onto the first hoop end of the flexible hoop. The compression spring can be kept short and compact and/or the plunge depth of the first hoop end of the flexible hoop into the lock body or into the first hoop receiver can be kept small by the extension piece. Provision can in particular be made that the extension piece—analogously to the first hoop end of a rigid hoop—has a longitudinal groove and that a further retaining pin is inserted into the first retaining pin passage and engages into the longitudinal groove of the extension piece to displaceably and captively hold the extension piece in the first hoop receiver.

In accordance with an embodiment of the invention, the cylinder core cooperates with the latch mechanism via an end face entrainer device. The latch mechanism preferably comprises two latches preloaded in opposite directions and respectively radially outwardly into the locked position in which the latches engage into respective locking sections formed in the first and second hoop ends in the closed position of the hoop to fix the hoop in the closed position. An automatic function is hereby implemented in which the two latches are briefly urged back radially inwardly to subsequently latch into the two locking sections so that the hoop is secured in its closed position at the lock body on the closing of the hoop or on the moving of the hoop from the open positon into the closed position, i.e. on the pressing down of a rigid hoop or on the pressing in of the first hoop end of a flexible hoop into the first hoop receiver. Provision can in particular be made for this purpose that the latches each have a chamfer at their radially outwardly directed latch ends. A one-hand operation of the padlock on closing is hereby made possible.

It is preferred in a configuration of the padlock if the locking sections are each formed as an at least partially peripheral groove around the longitudinal axis of the respective hoop end, in particular a fully peripheral annular groove, with the latches respectively having a concave, in particular partly cylindrical, cutout at their radially outwardly directed latch ends, said cutout being respectively formed in counter-shape to a portion of the respective groove facing the respective latch end. The material weakening of the respective hoop end is distributed more evenly by the at least partially peripheral groove with respect to a unilaterally arranged notch. It is made possible by the counter-shaped cutout that the latch ends can also engage laterally peripherally and thus ultimately more deeply into the at least partially peripheral groove so that a break-open attempt by a violent pulling of the hoop from the two hoop receivers can be increasingly counteracted.

The present invention also relates to a padlock having a lock body and a hoop that is movable between a closed position and an open position and that has a first hoop end and a second hoop end, wherein a first hoop receiver for the first hoop end and a second receiver for the second hoop end are formed in the lock body, wherein a latch mechanism is provided that is adjustable by means of a cylinder core rotatable about a cylinder axis between a locked position in which the latch mechanism fixes the hoop in the closed position and a release position in which the latch mechanism releases the hoop for a movement into the open position wherein the latch mechanism comprises two latches preloaded in opposite directions and respectively radially outwardly into the locked position in which the latches engage into respective locking sections formed in the first and second hoop ends in the closed position of the hoop to fix the hoop in the closed position, and wherein the locking sections are each formed as a groove at least partially peripheral around the longitudinal axis of the respective hoop end, with the latches having a respective concave cutout at their radially outwardly directed latch ends, said cutout being respectively counter-shaped to a part of the respective groove facing the respective latch end. Advantageous embodiments apply analogously to the aspect described in this paragraph.

In accordance with a further embodiment of the invention, the cylinder core can be directly received in a cylinder core receiver formed in the lock body and/or housing pins and pin springs can be directly received in housing pin bores that are formed in the lock body. A separate cylinder housing can then be dispensed with in this case. Since the functions of a cylinder housing, namely of rotatably supporting the cylinder core and of receiving the housing pins and the pin springs, are directly implemented in the lock body, the padlock can be particularly inexpensively manufactured. Associated core pins are also received in corresponding core pin bores formed in the cylinder core in the aforesaid case.

A plastic jacket can be pushed onto the lock body from the hoop side and a plastic flap is clipped onto it at the counter-hoop side or at the base side to form an outer housing for the lock body. Access to the lock body, in particular to the retaining pin or pins, can hereby be secured.

Provided that the padlock is offered and/or sold as a kit, provision can be made that both a rigid hoop and a flexible hoop are provided that are selectively mountable to the lock body so that the user can himself decide on the assembly which kind the padlock should be, i.e. whether with a rigid hoop or with a flexible hoop.

Further advantageous embodiments of the invention are described in the dependent claims, in the description of the Figures, and in the drawing.

The invention will be described in the following by way of example with reference to the drawing. There are shown FIG. 1 a cross-section through a padlock in accordance with the invention with a lock body, a latch mechanism, an outer housing, and a rigid hoop; and FIGS. 2A, 2B the padlock in accordance with FIG. 1 in a view from the front and above, with the lock body and the outer housing being omitted, and with the rigid hoop being replaced with a flexible hoop; and FIG. 3 the latch mechanism in accordance with FIG. 1 in a perspective individual representation.

The padlock 11 shown in FIG. 1 comprises a lock body 13 and a rigid or fixed U-shaped hoop 15, in particular composed of steel, for example stainless steel, and/or with a plastic cover 77, or composed of plastic, whose first hoop end 17 and whose second hoop end respectively engage into a first hoop receiver 21 respectively a second hoop receiver 23 of the lock body in the closed position shown. The first hoop end 17 has a greater length than the second hoop end 19. The first hoop receiver 21 correspondingly has a greater depth than the second hoop receiver 23. The lock body 13 is produced from aluminum. A key 25 is further shown that is associated with the padlock 11 and with which the rigid hoop 15 can be released for a displacement into the open position in which only its first hoop end 17 engages into the first hoop receiver 21.

The key 25 is inserted into a keyway of a cylinder core 27. The cylinder core 27 is formed substantially cylindrically with respect to a cylinder axis Z, is directly received in a cylinder core receiver 49 formed in the lock body 13, and is part of a cylinder arrangement that comprises eight tumblers 33 in addition to the cylinder core 27. The tumblers 33 each comprise a core pin 41, a housing pin 43, and a pin spring 45. Each tumbler 33 is received in a respective tumbler receiver that is formed by two bores of which one is formed directly in the lock body 13 and of which the other is formed in the cylinder core 27 and which are aligned radially to the cylinder axis Z. The bores in the lock body 13 are closed by a common tumbler cover 47 at their radially outwardly directed ends (cf. FIG. 2A).

The cylinder arrangement is coded by a respective combination of core pins 41 of different lengths for a specific key 25. If the key 25 introduced into the cylinder core 27 has suitably coded teeth, the core pins and the housing pins 41, 43 are displaced against the preload of the pin springs 45 such that the boundary surface between the core pin 41 and the housing pin 43 for all of the tumblers 33 coincides with the boundary surface between the cylinder core 27 and the cylinder core receiver 49. Only in this state can the cylinder core 27 then be rotated about its cylinder axis Z with respect to the lock body 13 and can thus be displaced out of the shown latching position into the unlatched position to release the hoop 15.

A holding pin 35 that engages radially inwardly into a cutout, not recognizable in the selected view, at the cylinder core 27 is received in parallel with the tumblers 33 in the lock body 13. This cutout is formed as a partial annular groove that extends over an angular range of effectively approximately 90° in the peripheral direction about the cylinder axis Z along a jacket surface 55 (cf. FIG. 2A) of the cylinder core 27. The length of the extent here restricts the rotational movability of the cylinder core 27 to a corresponding angular range. An axial displacement of the cylinder core 27 in the direction out of the cylinder core receiver 49 is additionally blocked relative to the lock body 13 direction with respect to the cylinder axis Z by the engagement of the holding pin 35 in the axial. In this manner, the cylinder core 27 is held axially in the cylinder core receiver 49 of the lock body 13.

The cylinder core 27 cooperates via an end face entrainer device 61 with a latch mechanism 63 (cf. in this respect also FIGS. 2A and 2B) that comprises two latches 65 preloaded by means of the compression spring 75 in opposite directions and radially outwardly. The latches 65 are preloaded into the shown position which corresponds to the latching position of the cylinder core 27 and in which they engage into respective annular locking sections 67 of the hoop 15 with a completely inserted hoop 15. In this respect, the latches 65 are chamfered (cf. the chamfer 81) such that the latches 65 are urged back against their preload on an introduction of the hoop 15 into the lock body 13 until they finally latch into the locking sections 67 again. The hoop 15 is subsequently locked in a shape-matching manner in the opposite direction of movement by the latches 65. A release of the hoop 15 can then only take place in that the cylinder core 27 is rotated out of the shown latched position about the cylinder axis Z into the unlatched position in which the entrainer device 61 displaces the latches 65 against their preload out of the locking sections 67. As soon as the hoop 15 is released, it is automatically displaced into its open position by a compression spring 69 that is only shown in FIG. 2A, that is inserted into the first hoop receiver 21, and that acts at the front face on the first hoop end 17 of the hoop 15.

The locking sections 67 are each formed as a completely peripheral annular groove that respectively extends around the longitudinal axis of the respective hoop end 17, 19. Matching this, the latches 65 have a respective concave, partly cylindrically shaped cutout 79 at their radially outwardly directed latch ends, said cutout 79 being counter-shaped to the part of the respective groove 67 facing the respective latch end (cf. FIG. 3).

To prevent the rigid hoop 15 from releasing from the lock body 13 in the open position, a longitudinal groove 29 is formed in the first hoop end 17 and a retaining pin 31 engages into it. The longitudinal groove 29 is bounded by a blocking projection 37 of the first hoop end 17 that abuts the retaining pin 31 in the open position. The rigid hoop 15, in particular the first hoop end 17, is thus displaceably supported in the lock body 13, on the one hand, and is secured against a removal from the lock body 13, on the other hand. The retaining pin 31 is inserted into a retaining pin passage 39 that completely passes through the lock body 13 and in so doing perpendicularly crosses the first hoop receiver 21, i.e. the retaining pin passage 39 opens into the first hoop receiver 21 so that the aforesaid engagement of the retaining pin 31 into the longitudinal groove 29 of the first hoop end 17 is possible. The second hoop end 19 in contrast travels out of the lock body 13 in the open position of the rigid hoop 15.

A second retaining pin passage 51 is furthermore formed in the lock body 13 and has the same cross-section as the first retaining pin passage 39 that likewise completely passes through the lock body 13 and that does not cross the first hoop receiver 21, but rather crosses, or opens into, the second hoop receiver 23. The second retaining pin passage 51 is arranged between the tumblers 33, on the one hand, and the latch mechanism 63, on the other hand. The first retaining pin passage 39 in contrast is arranged next to the tumblers 33 and thus beneath the second retaining pin passage 51. On a use of a rigid hoop such as is shown in FIG. 1, the second retaining pin passage 51 is not occupied, i.e. no retaining pin is inserted into the second retaining pin passage 51.

Figure 2A:
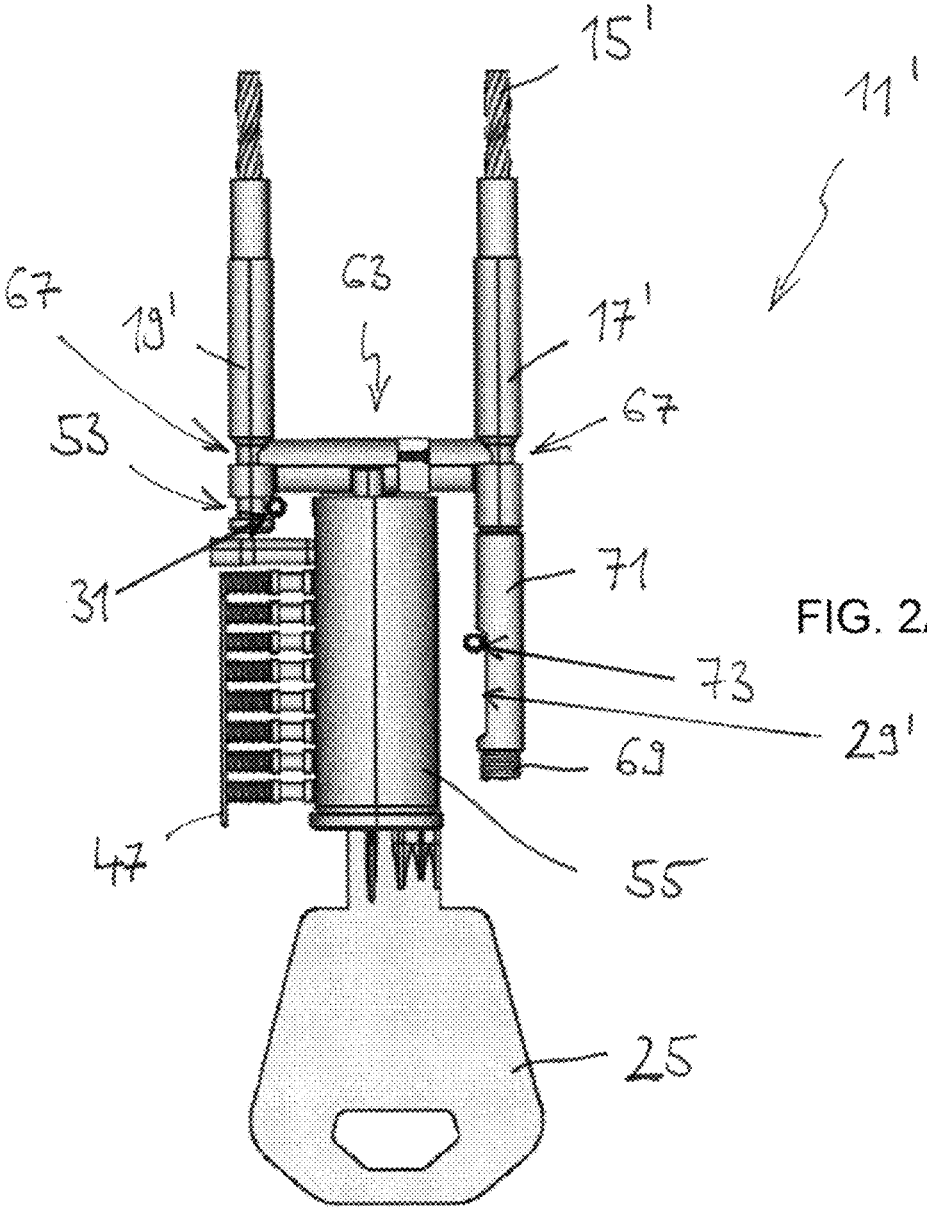
Figure 2B:
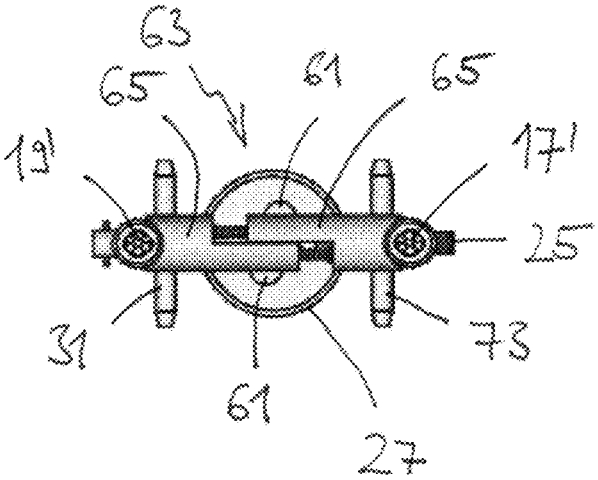
Figure 3:
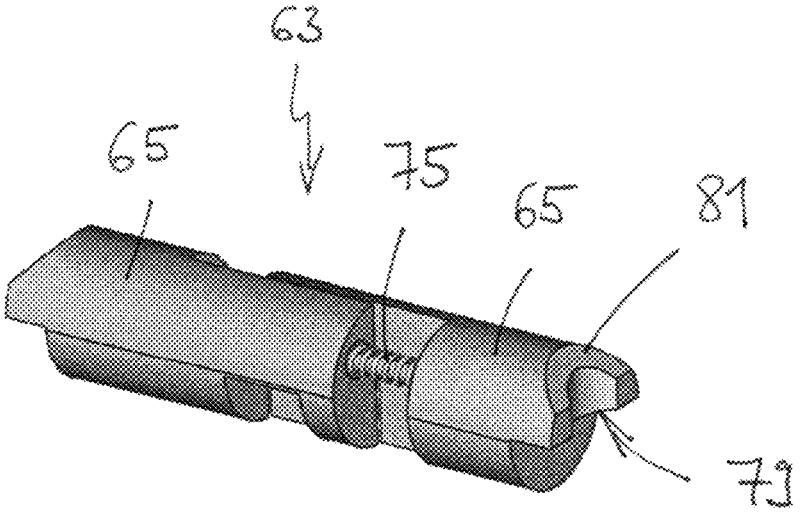

The second retaining pin passage 51 in contrast is used when the padlock 11 shown in FIG. 1 is not used with a rigid hoop 15, but rather as a padlock 11' having a flexible hoop 15' such as is shown in FIGS. 2A and 2B, in particular a cable hoop or wire hoop, whose two hoop ends 17', 19' have rigidly formed sleeves and plunge at least approximately equally far into the lock body 13. In this case, the retaining pin 31 is inserted into the second retaining pin passage 51. An annular recess 53 into which the retaining pin 31 engages is accordingly formed at the second hoop end 19 of the flexible hoop 15'. The second hoop end 19 of the flexible hoop 15' is thus flexibly secured in the second hoop receiver 23, i.e. it can also not be removed from the lock body 13 in the open position of the flexible hoop 15'. However, the first hoop end 17 is now removable rom the lock body 13 in the open position of the flexible hoop 15'.

Depending on whether the padlock 11 is manufactured with a rigid hoop 15 (FIG. 1) or a flexible hoop 15' (FIGS. 2A and 2B), the retaining pin 31 is inserted either into the first retaining pin passage 39 or into the second retaining pin passage 51 to retain the (respective) hoop 15, 15'. Either a padlock having a rigid hoop 15 or having a flexible hoop 15' can therefore be manufactured simply by the provision of two retaining pin passages 39, 51 with otherwise the same components—with the exception of the hoop.

To also enable the above-explained automatic ejection of the hoop 15' or of the first hoop end 17' of the hoop 15' from the lock housing 13 on an adjustment of the latch mechanism 63 into the release position with the padlock having a flexible hoop 15', an extension piece or adapter piece 71 is received in the first hoop receiver 21 that communicates the force exerted by the compression spring 69 to the first hoop end 17' of the flexible hoop 15'. To prevent a loss of the extension piece 71, the extension piece 71—like the first hoop end 17 of the rigid hoop 15—has a longitudinal groove 29' into which a further retaining pin 73 is inserted that engages into the longitudinal groove 29' of the extension piece 71 to hold the extension piece 71 displaceably and simultaneously in a secured manner in the first hoop receiver 21.

As can be seen from FIG. 1, a plastic jacket 57 is pushed onto the lock body 13 from the direction of the hoop 15 and a plastic flap 59 at the counter-hoop side is clipped onto it. An outer housing for the lock body 13 is thus formed so that access to the retaining pin or pins 31, 73 for manipulating the padlock 11 can be prevented.

REFERENCE NUMERAL LIST

11, 11' padlock
13 lock body
15, 15' hoop
17, 17' first hoop end
19, 19' second hoop end
21 first hoop receiver
23 second hoop receiver
25 key
27 cylinder core
29, 29' longitudinal groove
31 retaining pin
33 tumbler
35 holding pin
37 blocking projection
39 first retaining pin passage
41 core pin
43 housing pin
45 pin spring
47 tumbler cover
49 cylinder core receiver
51 second retaining pin passage
53 recess
55 jacket surface
57 plastic jacket
59 plastic flap
61 entrainer device
63 latch mechanism
65 latch
67 locking section
69 compression spring
71 extension piece
73 further retaining pin
75 compression spring
77 plastic cover
79 cutout
81 chamfer
Z cylinder axis

The invention claimed is:

1. A padlock having a lock body and a hoop, the hoop being movable between a closed position and an open position and the hoop having a first hoop end and a second hoop end, wherein a first hoop receiver for the first hoop end and a second hoop receiver for the second hoop end are formed in the lock body, wherein a latch mechanism is provided that is adjustable by means of a cylinder core rotatable about a cylinder axis between a locked position in which the latch mechanism fixes the hoop in the closed position and a release position in which the latch mechanism releases the hoop for a movement into the open position, wherein the hoop is formed as one of a rigid hoop and a flexible hoop, with both a first retaining pin passage for a rigid hoop and a second retaining pin passage for a flexible hoop being formed in the lock body, with the first retaining pin passage opening into the first hoop receiver and the second retaining pin passage opening into the second hoop receiver;

and with a retaining pin being provided that is inserted into the first retaining pin passage with a rigid hoop and is inserted into the second retaining pin passage with a flexible hoop, with the retaining pin, in the open position of the hoop, plunging into the first retaining pin passage and securing the first hoop end against a removal from the first hoop receiver with a rigid hoop, and plunging into the second retaining pin passage and securing the second hoop end against a removal from the second hoop receiver with a flexible hoop.

2. The padlock in accordance with claim 1, wherein the two retaining pin passages have the same cross-section.

3. The padlock in accordance with claim 2, wherein the two retaining pin passages have the same diameter.

4. The padlock in accordance with claim 1, wherein the second retaining pin passage is arranged above the first retaining pin passage and/or beneath the latch mechanism.

5. The padlock in accordance with claim 1, wherein a plurality of tumblers arranged above one another are provided, with the second retaining pin passage being arranged above the plurality of tumblers and/or the first retaining pin passage being arranged next to and/or beneath the uppermost of the plurality of tumblers.

6. The padlock in accordance with claim 1,
wherein with a rigid hoop, the first hoop end has a longitudinal groove into which the retaining pin engages to displaceably secure the first hoop end in the first hoop receiver.

7. The padlock in accordance with claim 1,
wherein with a rigid hoop, no further retaining pin is inserted into the second retaining pin passage.

8. The padlock in accordance with claim 1,
wherein with a flexible hoop, the second hoop end has a cutout into which the retaining pin engages to fixedly secure the second hoop end in the second hoop receiver.

9. The padlock in accordance with claim 1,
wherein a compression spring is received in the first hoop receiver that urges the first hoop end in the direction of the open position of the hoop.

10. The padlock in accordance with claim 9,
wherein with a flexible hoop, an extension piece is received in the first hoop receiver.

11. The padlock in accordance with claim 10,
wherein the extension piece has a longitudinal groove and a further retaining pin is inserted into the first retaining pin passage that engages into the longitudinal groove of the extension piece to displaceably secure the extension piece in the first hoop receiver.

12. The padlock in accordance with claim 1,
wherein the cylinder core cooperates via an end face entrainer device with the latch mechanism.

13. The padlock in accordance with claim 1,
wherein the latch mechanism comprises two latches preloaded in opposite directions and respectively radially outwardly into the locked position in which the latches in the closed position of the hoop engage into respective locking sections formed in the first and second hoop ends to fix the hoop in the closed position.

14. The padlock in accordance with claim 13,
wherein the latches have a respective chamfer at their radially outwardly directed latch ends.

15. The padlock in accordance with claim 13,
wherein the locking sections are each formed as a groove at least partially peripheral around the longitudinal axis of the respective hoop end, with the latches having a respective concave cutout at their radially outwardly directed latch ends, said cutout being respectively counter-shaped to a part of the respective groove facing the respective latch end.

16. The padlock in accordance with claim 1,
wherein the cylinder core is directly received in a cylinder core receiver formed in the lock body.

17. The padlock in accordance with claim 1,
wherein housing pins and pin springs are directly received in housing pin bores that are formed in the lock body.

18. The padlock in accordance with claim 1,
wherein a plastic jacket is pushed onto the lock body from the hoop side and a plastic flap at the counter-hoop side is clipped onto it to form an outer housing for the lock body.

19. The padlock in accordance with claim 1,
wherein both a rigid hoop and a flexible hoop are provided that are selectively mountable to the lock body.

* * * * *